US007314294B1

(12) United States Patent
Moore

(10) Patent No.: US 7,314,294 B1
(45) Date of Patent: Jan. 1, 2008

(54) HIGH INTENSITY LAMP WITH AN INSULATED HOUSING

(76) Inventor: Nick T. Moore, 745 1/2 Ave. F, Billings, MT (US) 59102

( * ) Notice: Subject to any disclaimer, the term of this patent is extended or adjusted under 35 U.S.C. 154(b) by 72 days.

(21) Appl. No.: 11/244,304

(22) Filed: Oct. 5, 2005

Related U.S. Application Data

(60) Provisional application No. 60/616,405, filed on Oct. 5, 2004.

(51) Int. Cl.
*F21V 29/00* (2006.01)

(52) U.S. Cl. ..... 362/373; 362/105; 362/294

(58) Field of Classification Search ..... None
See application file for complete search history.

(56) References Cited

U.S. PATENT DOCUMENTS

| | | | | |
|---|---|---|---|---|
| 2,217,359 | A | 10/1940 | Cooke | |
| 3,008,040 | A | 11/1961 | Moore | |
| 4,321,659 | A | 3/1982 | Wheeler | |
| 4,394,337 | A * | 7/1983 | Kummermehr | 264/122 |
| 4,546,420 | A | 10/1985 | Wheeler et al. | |
| 5,001,608 | A | 3/1991 | Kehrli et al. | |
| 5,136,489 | A * | 8/1992 | Cheng et al. | 362/294 |
| 5,428,517 | A | 6/1995 | Behringer | |
| 5,667,291 | A | 9/1997 | Caplan | |
| H1876 | H | 10/2000 | Knox et al. | |
| 6,132,061 | A * | 10/2000 | Andrus et al. | 362/217 |
| 6,527,418 | B1 | 3/2003 | Scherba | |
| 6,865,285 | B1 * | 3/2005 | Villa-Aleman | 382/124 |
| 6,908,208 | B1 * | 6/2005 | Hyde et al. | 362/105 |
| 2004/0120148 | A1 * | 6/2004 | Morris et al. | 362/264 |
| 2004/0120151 | A1 | 6/2004 | Ostler et al. | |

* cited by examiner

*Primary Examiner*—Sandra O'Shea
*Assistant Examiner*—Kristen A Manskar
(74) *Attorney, Agent, or Firm*—Richard C. Conover

(57) ABSTRACT

A light according to the present invention includes a high intensity lamp electrically connected to a power source located in a lamp connector body portion. The lamp is positioned to extend outside the lamp connector body portion and is received by a lamp housing portion which has an end through which the light from the high intensity lamp is projected. The lamp housing portion includes an outer casing shell and an inner shell in spaced apart relation and heat insulating material fills the space between the outer casing shell and the inner shell. Vent holes are provided which fluidly extend through the outer casing shell, the heat insulating material and the inner shell. Further a fan is positioned within the lamp connector body portion for directing air toward the high intensity lamp and out through the vent holes.

4 Claims, 4 Drawing Sheets

HIGH INTENSITY LAMP WITH AN INSULATED HOUSING

This application claims the benefit of provisional application Ser. No. 60/616,405 filed Oct. 5, 2004.

BACKGROUND OF INVENTION

The present invention relates to a high intensity lamp with an insulated housing.

A need exists by physicians, dentists, veterinarians and others for a light which can be worn with a head set to provide a strong light source on the object being worked upon while enabling the user to have free use of the user's hands for manipulating tools in performing the work. A problem with high intensity lamps is that they become hot when used and therefore it is necessary to provide means for cooling the lamp. A number of lamp housings which are mounted to head sets are known including U.S. Pat. No. 6,908,208 to Hyde et al, U.S. Pat. No. 5,428,517 to Behringer and U.S. Pat. No. 3,008,040 to Moore. When these lamps are used with a high intensity lamp, the casing becomes very hot from the heat generated by the lamp. It is desirable to provide a housing for the lamp which remains cool to the touch. Further it is desirable that when the high intensity lamp must be changed, the lamp can be easily removed from the housing and the lamp replaced.

SUMMARY OF INVENTION

A light according to the present invention includes a high intensity lamp electrically connected to a power source located in a lamp connector body portion. The lamp is positioned to extend outside the lamp connector body portion and is received by a lamp housing portion which has an end through which the light from the high intensity lamp is projected. The lamp housing portion includes an outer casing shell and an inner shell in spaced apart relation and heat insulating material fills the space between the outer casing shell and the inner shell. Vent holes are provided which fluidly extend through the outer casing shell, the heat insulating material and the inner shell. Further a fan is positioned within the lamp connector body portion for directing air toward the high intensity lamp and out through the vent holes.

BRIEF DESCRIPTION OF THE DRAWINGS

In order that the invention may be clearly understood and readily carried into effect, a preferred embodiment of the invention will now be described, by way of example only, with reference to the accompanying photographs and drawings wherein.

DESCRIPTION OF A PREFERRED EMBODIMENT

Figure 1:
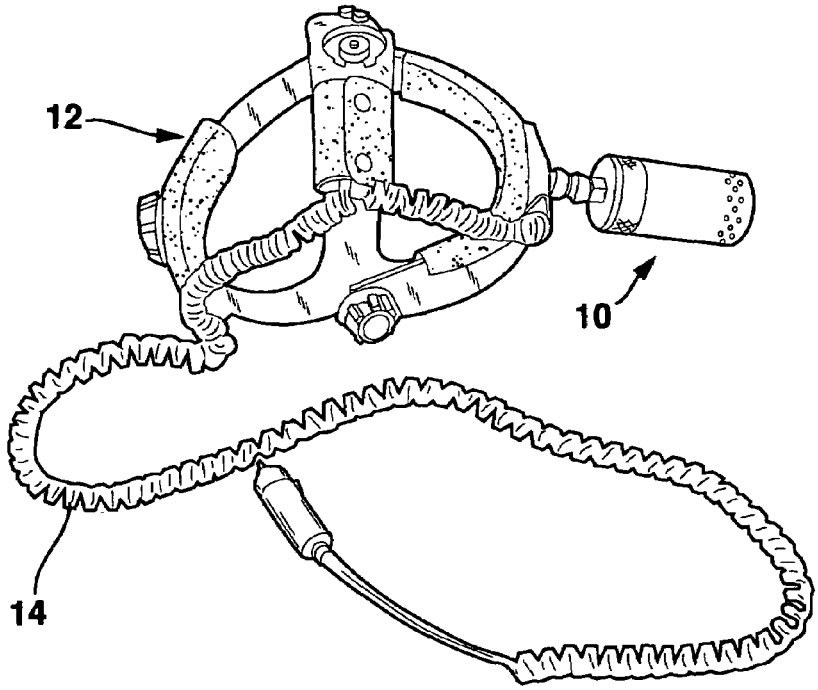
FIG. 1 is a perspective view of the present invention mounted to a conventional headset.
Figure 2:
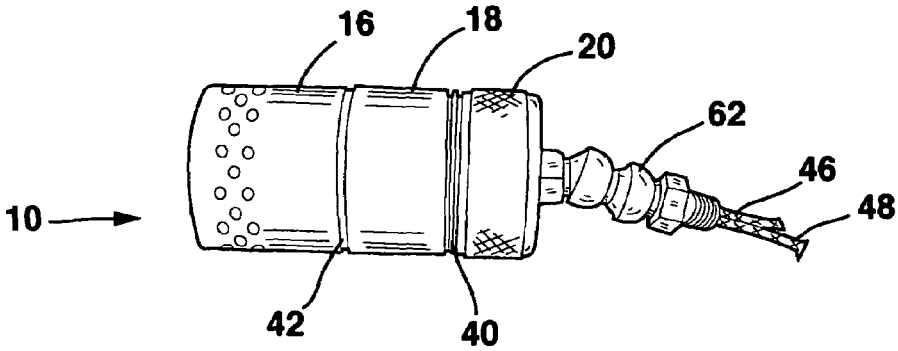
FIG. 2 is a perspective view of a housing according to the present invention.
Figure 3:
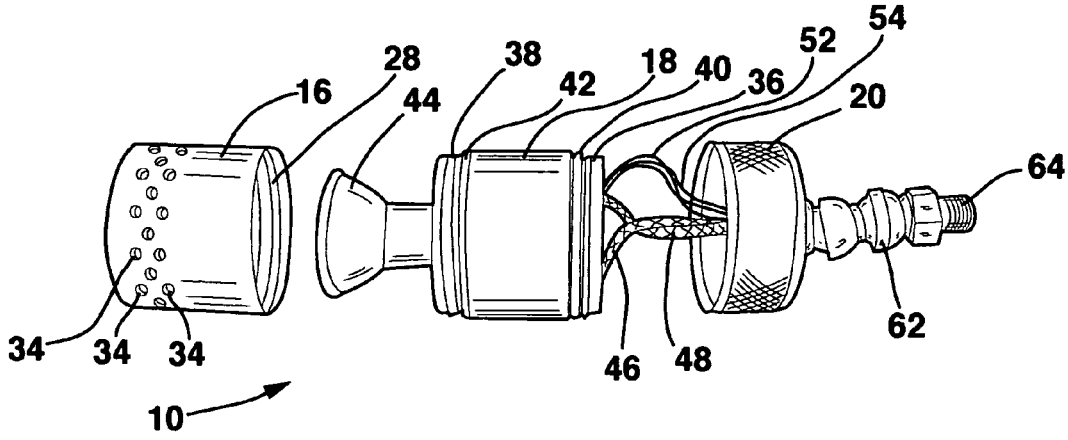
FIG. 3 is an exploded view of the housing shown in FIG. 2.

A housing 10 for a replaceable high intensity lamp is shown in FIGS. 1,2 and 3. As shown in FIG. 1, the housing 10 can be mounted to a conventional headset 12 provided with a power cord 14.

Figure 4:
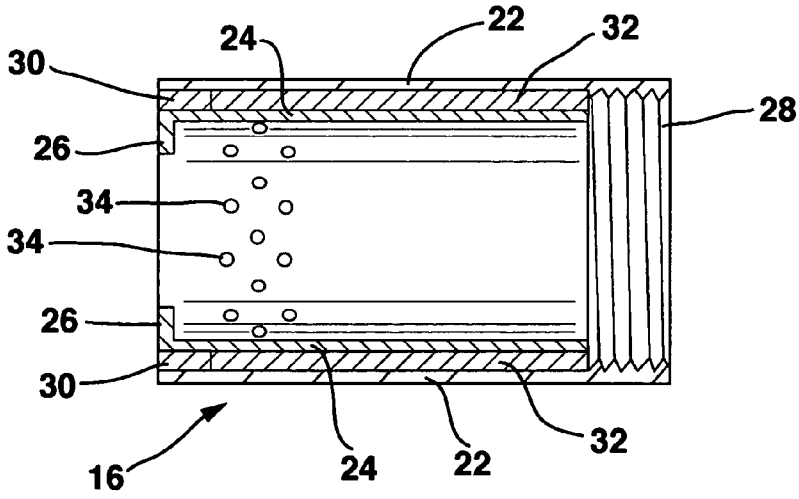
FIG. 4 is a cross-sectional view of one of the cylindrical shells shown in FIG. 3.

The housing 10 includes three connected cylindrical shells 16, 18 and 20. A cross sectional view of the cylindrical 16 is shown in FIG. 4. The cylindrical shell 16 has an outer casing 22 which in a preferred embodiment is formed of aluminum. A tubular portion 24 having a diameter less than outer casing 22 is inserted into the casing 22 as shown in FIG. 4 leaving a gap in between tubular portion 24 and casing 22. The tubular portion 24 has at one end an interiorly extending flange 26. At the opposite end of the shell 16 female threads 28 are provided on the interior of casing 22. At the forward end of shell 16, a high temperature epoxy 30 is positioned between the tubular portion 24 and the outer casing 22 to bond the tubular portion to the casing. An aluminum oxide putty 32 which in a preferred embodiment comprises a putty with the trade name "THERMEEZ" is used to fill the remaining gap between the tubular portion 24 and the outer casing 22 and to further bond the tubular portion 24 to the casing 22. Aluminum Oxide putty has the property of acting as a heat insulator.

A series of venting holes 34 are provided in the shell 16 which extend through the aluminum casing 22, the aluminum oxide 32 and the tubular portion 24 which provide venting from the interior of the tubular portion 24 to the outside air.

Figure 5:
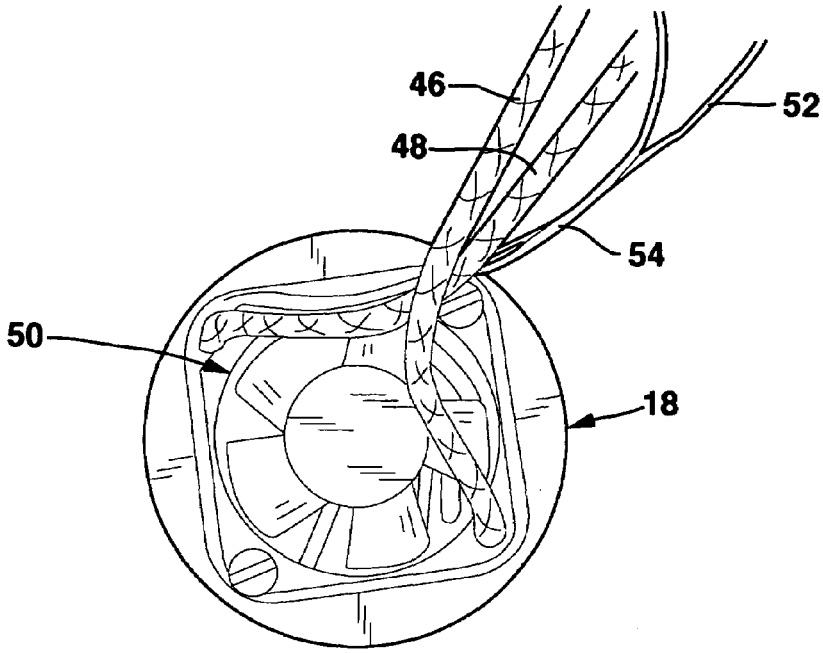
FIG. 5 is a right end view of another one of the cylindrical shells shown in FIG. 3.

The cylindrical shell 18 is shown in FIGS. 3 and 5. The shell 18 is provided with exterior male threads 36 and 38 at each end as shown in FIG. 3. Sealing "O" rings are provided at 40 and 42 as shown. The male threads 38 are sized to be received by the female threads 28 of shell 16.

Figure 6:
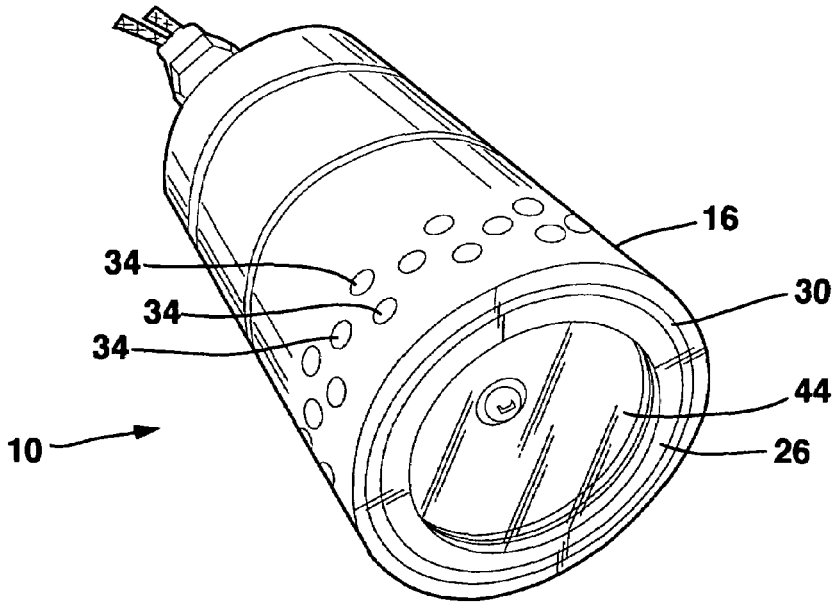
FIG. 6 is an end perspective view of the assembled housing with a high intensity lamp according to the present invention.
Figure 8:
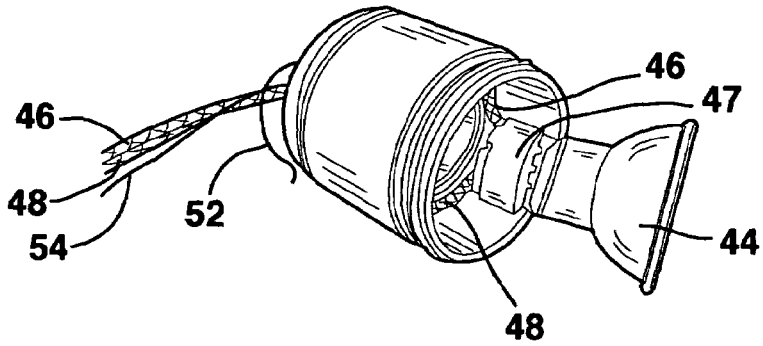
FIG. 8 is a left end perspective view of one of the cylindrical shells shown in FIG. 3.

A high intensity, bi-pin, halogen lamp 44 is positioned within shell 18. Shell 16 is sized to receive the lamp 44 with the lamp 44 having its distal end resting against the flange 26 as shown in FIG. 6. In a preferred embodiment the halogen lamp 44 is a bi-pin MR 11 Halogen Lamp. The pins of the halogen lamp 44 are received by a conventional socket 47 mounted in shell 18. The socket is powered with power leads 46 and 48 as shown in FIG. 3 and FIG. 8. Leads 46 and 48 are connected to the power cord 14 shown in FIG. 1.

A conventional low power fan 50 is mounted at one end of shell 18 as shown in FIG. 5. A pair of power leads 52 and 54 are used to power the fan 50 and are connected to the power cord 14.

Figure 7:
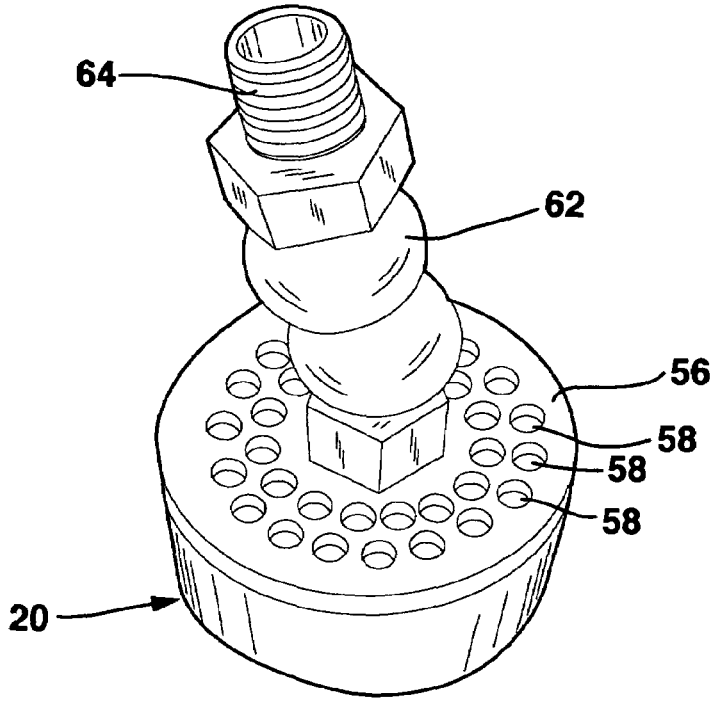
FIG. 7 is an end perspective view of another one of the cylindrical shells shown in FIG. 3.

The cylindrical shell 20 is shown in FIGS. 3 and 7. The shell 20 has a closed end wall 56 provided with venting holes 58 as shown in FIG. 7. At the end of shell 20 opposite the wall 56, interior female threads 60 are provided. The female threads 60 are sized to receive the male threads 36 of shell 18.

A hollow ball and socket joint 62 extends through a hole (not shown) in the end wall 56. Power leads 44, 46 and 52, 54 are led through the hollow ball and socket joint 62. The ball and socket joint is provided with a threaded end 64 which can be used for mounting the high intensity lamp 10 to the headset 12 as shown in FIG. 1. At the headset, the leads 44, 46, 52 and 54 are connected to the power cord 14.

A switch (not shown) is provided in the headset 12 for providing power to the leads 44, 46 and 52, 54.

The assembled housing with a high intensity lamp is shown in FIGS. 2 and 6. When the high intensity lamp and fan are turned on cooling air is drawn from the outside air through venting holes 58 provided in shell 20 into the interior of housing 10 and out through the venting holes 34 provided in shell 16. Further, the aluminum oxide provided in shell 16 surrounding the lamp 44 acts as an insulator preventing heat to be transferred to the casing 23.

With the present invention, the housing 10 which holds a high intensity halogen light can be disassembled allowing a user to replace the halogen lamps when necessary. Further, with the present invention, the aluminum oxide insulation 32 and cooling fan 50 maintain the casing in a cool condition. The casing is not used for heat dissipation.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as described by the following claims:

I claim:

1. A light comprising:

a high intensity lamp having a light producing source at one end and means positioned at a second end for releasably connecting the lamp to an electrical power source;

a lamp connector body portion having an electrical socket provided at a first end for electrically receiving the high intensity lamp with the light producing source positioned to extend outside the first end of the lamp connector body portion;

a lamp housing portion for receiving the light producing source and having a first end releasably connected to the lamp connector body portion and further having an open end distal from the first end through which light from the high intensity lamp is projected;

the lamp housing portion further having an outer casing shell and an inner shell spaced apart from the outer casing shell;

a heat insulating material filling the space between the outer casing shell and the inner shell;

vent holes fluidly extending through the outer casing shell, the heat insulating material, and the inner shell;

a fan means positioned at a second end of the lamp connector body portion for directing air toward the high intensity lamp and out through the vent holes; and means for electrically connecting the electrical socket and the fan to an electrical power source.

2. The light according to claim 1 wherein the heat insulating material is comprised of an aluminum oxide material.

3. The light according to claim 1 further including a cap for enclosing the second end of the lamp connector body portion, the cap having through holes through which air is drawn by the fan.

4. The light according to claim 1 further including a connecting means for mounting the light to an external head set.

* * * * *